US007245077B2

(12) United States Patent
Amano

(10) Patent No.: US 7,245,077 B2
(45) Date of Patent: Jul. 17, 2007

(54) STRUCTURE OF AC TYPE PDP

(75) Inventor: Yoshifumi Amano, Kanagawa (JP)

(73) Assignee: Technology Trade and Transfer Corporation, Kanagawa (JP)

( * ) Notice: Subject to any disclaimer, the term of this patent is extended or adjusted under 35 U.S.C. 154(b) by 268 days.

(21) Appl. No.: 10/504,401

(22) PCT Filed: Sep. 16, 2003

(86) PCT No.: PCT/JP03/11777

§ 371 (c)(1),
(2), (4) Date: Jan. 24, 2005

(87) PCT Pub. No.: WO2004/049374

PCT Pub. Date: Jun. 10, 2004

(65) Prior Publication Data

US 2005/0127838 A1 Jun. 16, 2005

(30) Foreign Application Priority Data

Nov. 25, 2002 (JP) ..... 2002-382669

(51) Int. Cl.
*H01J 17/49* (2006.01)

(52) U.S. Cl. ..... 313/582; 313/586

(58) Field of Classification Search ..... 313/582, 313/586, 581, 583, 584
See application file for complete search history.

(56) References Cited

U.S. PATENT DOCUMENTS 6,541,913 B1 4/2003 Mori et al.

FOREIGN PATENT DOCUMENTS

| | | |
|---|---|---|
| EP | 1065695 | 1/2001 |
| JP | 2-132731 | 5/1990 |
| JP | 11-238462 | 8/1999 |
| JP | 11-273573 | 10/1999 |
| JP | 2001-76630 | 3/2001 |
| KR | 2001-0029871 | 4/2001 |

*Primary Examiner*—Vip Patel
(74) *Attorney, Agent, or Firm*—Frommer Lawrence & Haug LLP; William S. Frommer; Thomas F. Presson

(57) ABSTRACT

Almost only choice by a secondary electron emission layer/protection layer covering the dielectric layer of an AC type PDP has been magnesium oxide (MgO) that is unstable during the production process and difficult to form, thus posing a serious production problem. An AC type PDP constructed such that, instead of covering the surface of a dielectric layer with a dielectric material such as MgO, an insular electrode is made by forming a conductive material such as nickel, aluminum, magnesium and lanthanum hexaboride into an insular shape, and the insular electrode is allowed to capacity-couple with a lower-layer bus electrode by means of an electrostatic capacity formed by a dielectric layer to operate the insular electrode as a sustained electrode.

13 Claims, 9 Drawing Sheets

STRUCTURE OF AC TYPE PDP

TECHNICAL FIELD

The present invention relates to a structure of a display device to which gas discharge is applied, that is, a so-called PDP (plasma display panel).

BACKGROUND ART

A PDP (plasma display panel) is roughly classified into an AC type PDP and a DC type PDP from the characteristics of its electrode structure.

As shown in FIG. 3B, the AC type PDP has a structure in which the surface of an electrode 2 is covered with a dielectric layer 3 in which an electrostatic capacitance 7 is formed, the surface of the dielectric layer being covered with a dielectric material 5 such as magnesium oxide with a high secondary electron radiation property. On the other hand, the DC type PDP is characterized by a structure in which the surface of an electrode is not covered with a dielectric layer but exposed to the discharge space to directly radiate secondary electrons from the surface of the electrode although not shown.

Since the ordinary AC type PDP has a so-called reflection type structure in which a discharge electrode is disposed on the front surface side, the electrode 2 should be formed as a transparent electrode. In general, an indium tin oxide layer, which might be called an ITO layer, is high in electric resistance and hence the resistance should be lowered by compensating for the electric resistance. Thus, it is customary that a metal electrode with a high conductivity, which might be called a bus electrode 9, is superposed upon the electrode 2.

From an operation standpoint, the above two plasma display panels have the following characteristics. The AC type PDP is characterized in that charged particles generated by discharge are accumulated on the surface of the dielectric layer covering the electrode 2 and the surface of the magnesium oxide layer 5 to form so-called wall electric charges, charges being continued with application of an AC type pulse voltage to the place between a pair of the electrode 2 and the bus electrode 9 by using a so-called wall voltage produced therein to render the whole of pixels memory functions. Since the DC type PDP is not given the above-described memory function because the surface of the pixel is conductive but it is characterized in that a discharge current of a direct current continues to flow during a time period in which it is being applied with a constant discharge current to thereby discharge to emit light.

As described above, although the AC type PDP is featured in that electric charges are accumulated on the surface of the electrode, since a material of the dielectric layer formed for that purpose, that is, a low melting-point glass is low in secondary electron radiation rate and has poor durability against ion bombardment, the surface of this dielectric layer should be coated with a material such as the above-mentioned magnesium oxide MgO having a high secondary electron radiation rate and which is strong against ion bombardment as the protective layer of the cathode layer and the dielectric layer.

In this case, in order to enable the electrode 2 with the above-mentioned structure to operate as the AC type electrode, this protective layer 5 should be made of a dielectric material to accumulate wall electric charges on the surface of the cathode layer and protective layer 5.

Also, in addition to the AC type PDP having the fundamental structure shown in FIG. 3B, there has been proposed an AC type PDP having a structure whose structure and operation are the same as those of the AC type PDP with the fundamental structure but in which pad-like intermediate layers 8 are laminated on the pair of opposing discharge electrodes 2 at their distant portions through dielectric layers as is shown in a cross-sectional view of FIG. 3C. Also in this case, since the pad-like intermediate electrode 8 is covered with the MgO layer 5, its operation is the same as that of the AC type PDP with the fundamental structure.

As described above, in the conventional AC type PDP, since the surface of the dielectric layer should be covered with other dielectric layer serving as the cathode layer and protective layer, its material has to be selected in an extremely narrow range and only the magnesium oxide MgO is used as such material in actual practice.

However, such oxide material is very unstable from a property standpoint and hence it is difficult to make. Although it is customary to form such oxide material by a vacuum deposition method or a sputtering method, any one of methods needs a long treatment time because the whole of substrate is treated by a heating treatment within a vacuum apparatus which is highly evacuated.

Further, the manufacturing process has encountered with a serious problem in which MgO is high in hygroscopic property so that it is easily changed into $Mg(OH)_2$, that is, magnesium hydroxide, its function as the cathode material being lost. Hence, its process has been regarded as the most difficult process in the manufacturing process of PDP.

DISCLOSURE OF THE INVENTION

According to the present invention, in order to solve the above-described problem, it is an object of the present invention to propose an AC type PDP electrode structure in which a metal or conductive material which can easily be formed is formed on a dielectric layer by an easier process such as a screen printing method without using an oxide dielectric cathode material such as MgO which is difficult to form and which has an electric charge accumulating function.

In order to explain actions of the electrode structure of the present invention, FIG. 3A shows a schematic cross-sectional view of the electrode structure according to the present invention; in order to explain a difference between the actions of this structure and the conventional system, FIG. 3B shows a cross-sectional view of an AC type PDP with a fundamental structure according to the related art; and FIG. 3C shows an AC type PDP with a structure in which a pad-like intermediate electrode is sandwiched at a part between a dielectric layer 3 and a protective layer 5 as a modified example of FIG. 3B.

First, in the PDP with the conventional structure shown in FIG. 3B, an electrode 2 is formed on a substrate 1 and it is covered with a dielectric layer 3. The upper surface of the dielectric layer 3 is generally covered with a secondary electron radiation layer such as magnesium oxide MgO, that is, a cathode and protective layer 5.

Also, as shown in FIG. 3C, the uppermost surface is similarly covered with the cathode and protective layer 5.

On the other hand, the present invention is characterized in that a conductive cathode material, for example, an island electrode 4 shown in FIG. 3A is formed instead of the Mgo layer.

Having compared FIG. 3A with FIGS. 3B and 3C, it is to be understood that they are the same in that any one of them includes the dielectric layer 3 and that it accumulates electric charges, that is, so-called wall electric charges on the surface contacting with the discharge space by using the electrostatic capacitance 7 formed on the dielectric layer.

In the conventional plasma display panels shown in FIGS. 3B and 3C, an electrostatic capacitance is distributed on the surface of the dielectric layer near the electrode 2. Also, since the cathode and protective layer 5 uniformly coated on the whole surface in the condition that it is laminated on this dielectric layer is also a dielectric material such as MgO, wall electric charges accumulated in the cathode and protective layer are also distributed on the electrode.

On the other hand, in the AC type PDP electrode structure of the present invention shown in FIG. 3A, since the electrostatic capacitance is based upon the dielectric layer 3 sandwiched between the bus electrode 9 and the island electrode 4 and the surface potential on the electrode 4 that is the conductive material is uniform, the electrostatic capacitance is a so-called concentrated capacitance which is not distributed on the electrode surface.

Even though the plasma display panel of the present invention is different from the conventional ones from a structure standpoint, it is needless to say that the wall electric charge accumulation function is the same as that of the conventional arrangement. Hence, even though the conductive cathode material (island electrode 4) is formed on the surface, the plasma display panel of the present invention can be operated as an AC type PDP.

In the conventional PDP, it is difficult to select a proper material of the dielectric layer 3, which can protect the dielectric layer and which can be operated as the cathode, from a wide range of materials, and hence only MgO was used as the material of the dielectric layer in actual practice.

However, since the MgO layer is formed by a thin film process such as a vacuum-deposition process, the manufacturing facilities are expensive and the manufacturing processes are also unstable.

On the other hand, according to the electrode structure of the present invention, since the dielectric layer 3 is required only to form an electrostatic capacitance and is not required to have a secondary electron radiation function, that is, a cathode function, the protective layer such as MgO need not be provided and the material of the dielectric layer 3 can be selected from a wide range of metal materials which had already have good results as cathode materials.

Further, also from a manufacturing standpoint, since the dielectric layer 3 and other layers can be formed by a thick film forming process such as a screen printing, the manufacturing facilities are inexpensive and the process time can be reduced considerably, which can decrease a manufacturing cost considerably.

BEST MODE FOR CARRYING OUT THE INVENTION

Figure 1:
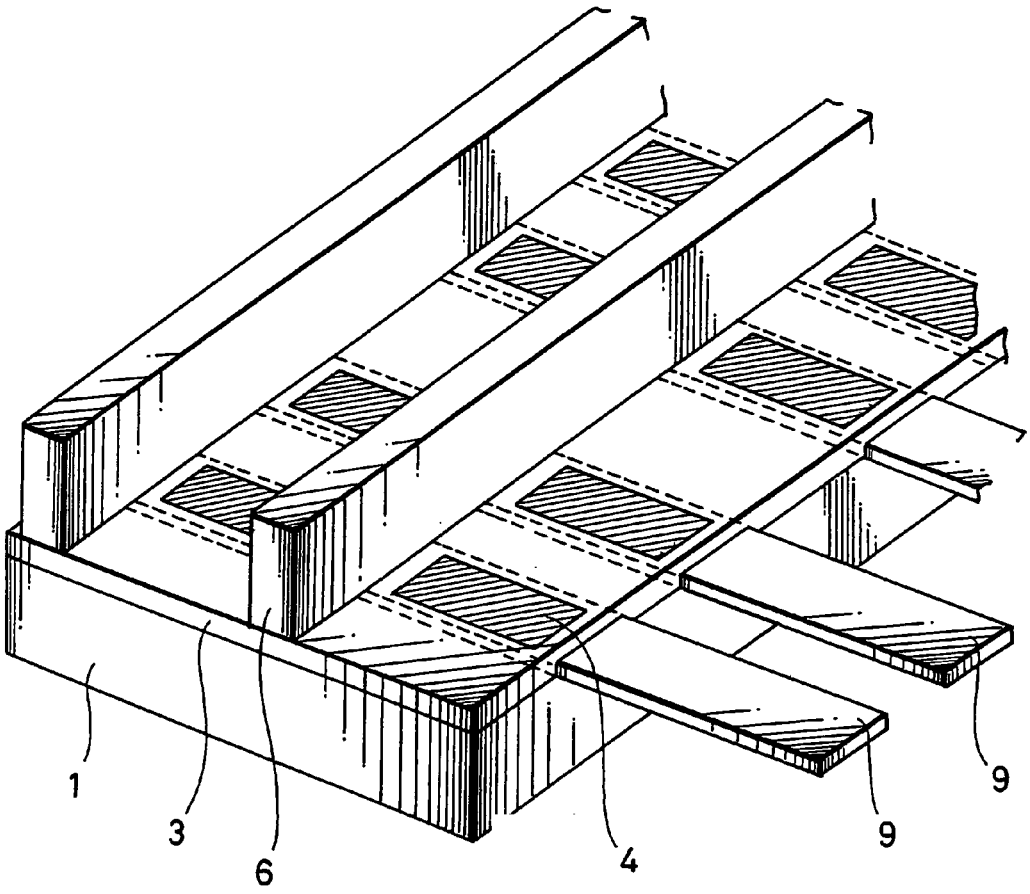
FIG. 1 is a development perspective view of a pixel portion showing an electrode structure according to the present invention.

FIG. 1 is a development perspective view of a pixel portion which is used to explain an embodiment of the present invention.

In order to facilitate the understanding of the present invention, FIG. 1 shows an example of a rear surface plate of a PDP including a so-called transmission type fluorescent screen.

Although the following members are not shown in FIG. 1 because they are not directly related to the present invention, a front surface side substrate is opposed to a rear surface glass substrate 1 shown, a fluorescent substance is coated on the front surface side of the transmission type fluorescent screen and address electrodes are further disposed in an opposing fashion to a pair of electrodes 9 shown in FIG. 1.

First, a pair of bus electrodes 9 for display discharge is formed on the rear surface glass substrate 1. The bus electrodes can easily be obtained by baking a conductive material such as a silver paste after such conductive material has been treated by the screen printing method.

Also, the bus electrodes 9 are covered by the dielectric layer 3.

The dielectric layer 3 can easily be obtained by baking a low melting-point glass paste at about 550° C. after such glass paste was coated with a thickness ranging from 20 to 30 μm by a suitable method such as a similar screen printing method.

Then, an island-like electrode (island electrode) 4 is formed so as to be superposed upon the dielectric layer 3 through the bus electrode 9 and the dielectric layer 3.

The island electrode 4 can be formed by a pattern forming method based upon a photo-sensitive conductive film in addition to the screen printing method.

As the material of the island electrode 4, there can be used a conductive material with a high secondary electron radiation capability and which is also strong against the ion bombardment, for example, nickel, aluminum, barium. When in use, very small powders of these materials can be changed into ink paste-like materials and printed by the screen printing method. Also, it was confirmed that compounds such as lanthanum hexaboride $LaB_6$ are high in secondary electron radiation rate and that they are high in durability against the ion bombardment of discharge gas.

Since these materials are conductive materials, they have good results in which they can be used in the conventional DC type PDP, according to the structure of the present invention, these materials can be applied to the AC type PDP.

Since the necessary conditions of the island electrode 4 are that it should be made of the conductive material, its pattern should be separated at every pixel but its shape can be modified variously.

FIGS. 2 are top views of FIG. 1 and show several examples of the patterns of the island electrodes 4.

Figure 2A:
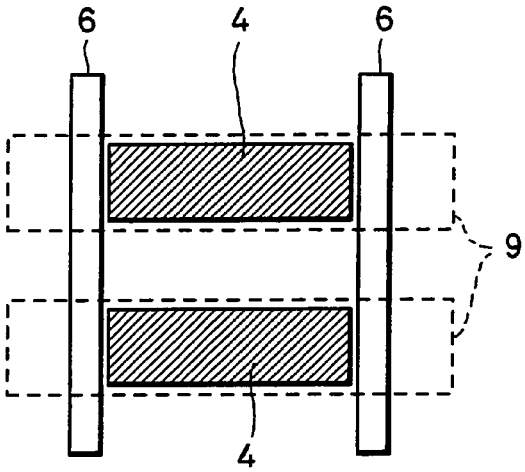
FIGS. 2A to 2D are diagrams showing examples of electrode patterns according to the present invention.

In each pattern, the bus electrodes 9 divided by partitions 6 are used to form each pixel. FIG. 2A shows an example of the square island electrode 4 formed on the electrode 9 at its portion corresponding to the pixel.

Figure 2B:
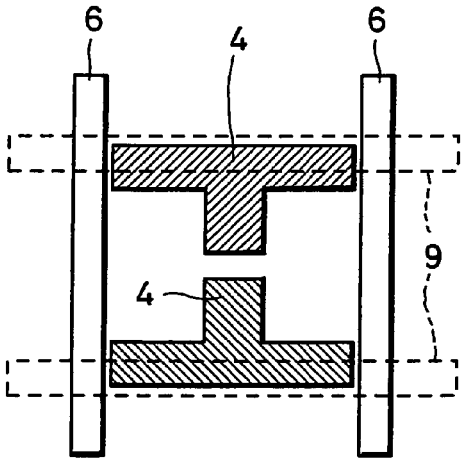

FIG. 2B shows an example in which tip end portions of the opposing island electrodes 4 are shaped like antennas. In this case, discharge is first generated at the tip end of the island electrode and it is immediately introduced into distant parallel electrodes (portions extending along the electrodes 9).

In general, although it is attempted to widen the space between the electrodes 9 in order to decrease an interelectrode capacitance between the respective electrodes 9, the ordinary method should not be preferable because a discharge voltage is raised unavoidably.

However, according to the pattern of the island electrode 4 shown in FIG. 2B, since the space between the tip ends of the island electrodes 4 is smaller than that between the tip ends of the bus electrodes 9 and an antenna effect is produced at the tip ends of the island electrodes 4, although the space between the bus electrodes 9 is increased, the discharge voltage can be prevented from being increased and the interelectrode capacitance can be decreased at the same time, which can increase a light emission efficiency.

Figure 2C:
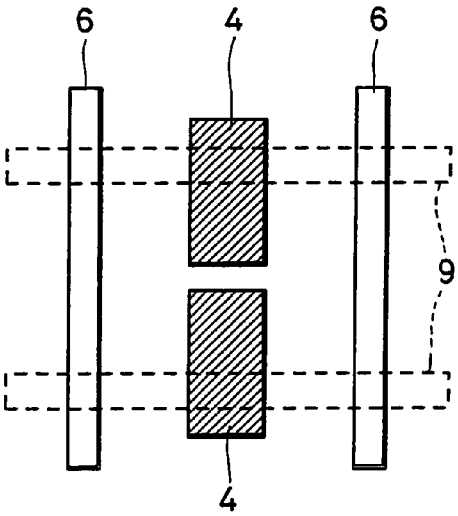

In the case of FIG. 2C, the island electrode 4 is shaped like the square electrode perpendicular to the bus electrode 9 so that, when the electrode is formed, the bus electrode 9 and the island electrode 4 can be aligned with each other extremely easily.

Figure 2D:
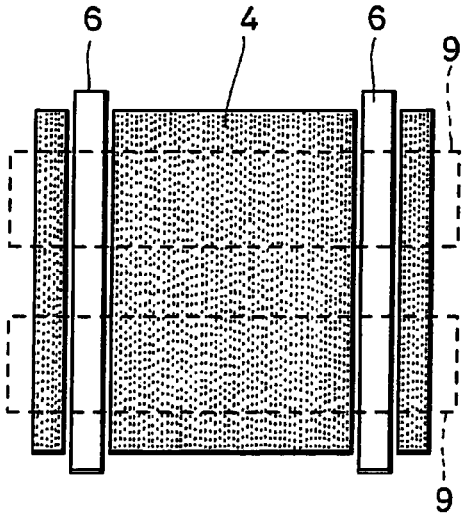
Figure 3A:
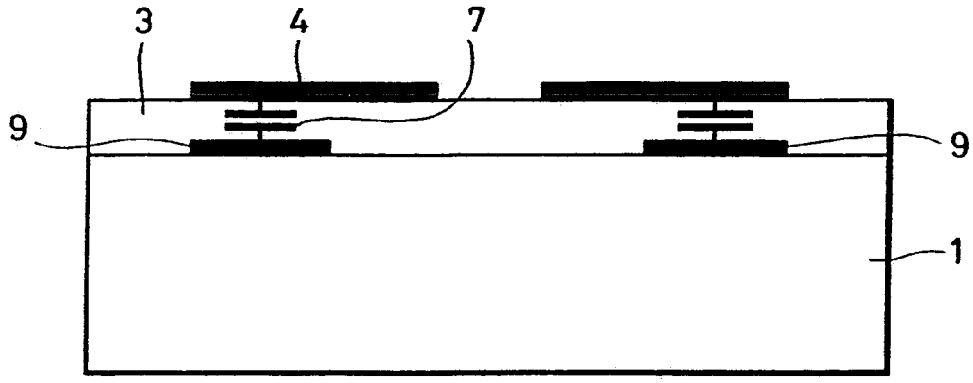
FIG. 3A is a schematic cross-sectional view of an electrode structure according to the present invention.
Figure 3B:
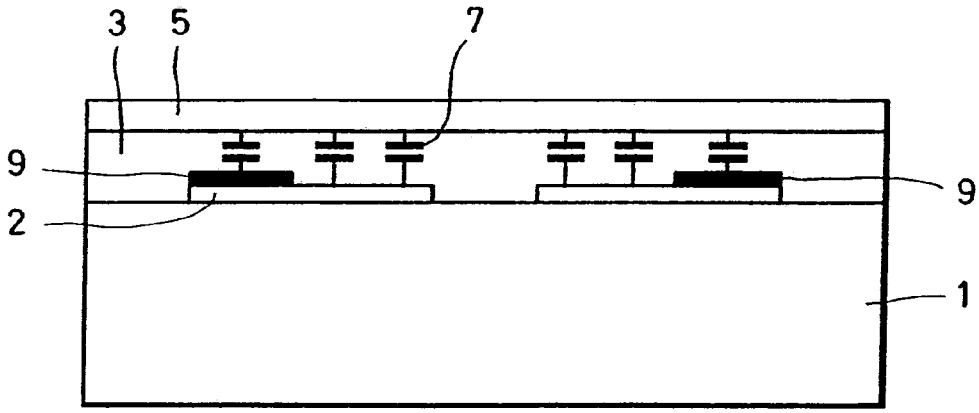
FIG. 3B (PRIOR ART)
FIG. 3B is a schematic cross-sectional view of an electrode structure according to the related art.
Figure 3C:
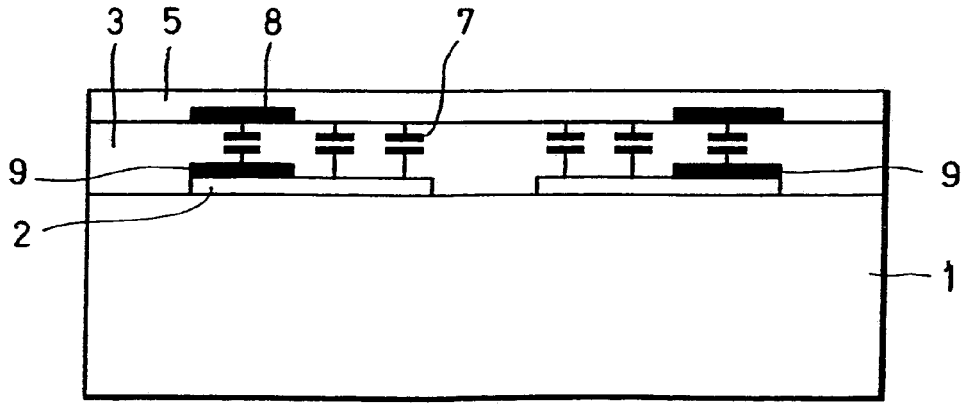
FIG. 3C (PRIOR ART)
FIG. 3C is a schematic cross-sectional view of a modified example of a conventional structure.

Further, in the case of FIG. 2D, since the island electrode 4 is distributed like dot-like electrode with an area smaller than that of the pixel, the island electrode and the bus electrode 9 can be aligned with each other more easily.

Also, although the operation of the island electrode shown in FIG. 2D is the same as those of the island electrodes shown in FIGS. 2A to 2C, the structure of the island electrode 4 is different from the island electrodes shown in FIGS. 2A to 2C in which the island electrode is shaped like the continuous surface electrode only in that the island electrode 4 is comprised of very small dot-like electrodes distributed on the whole surface.

Figure 4:
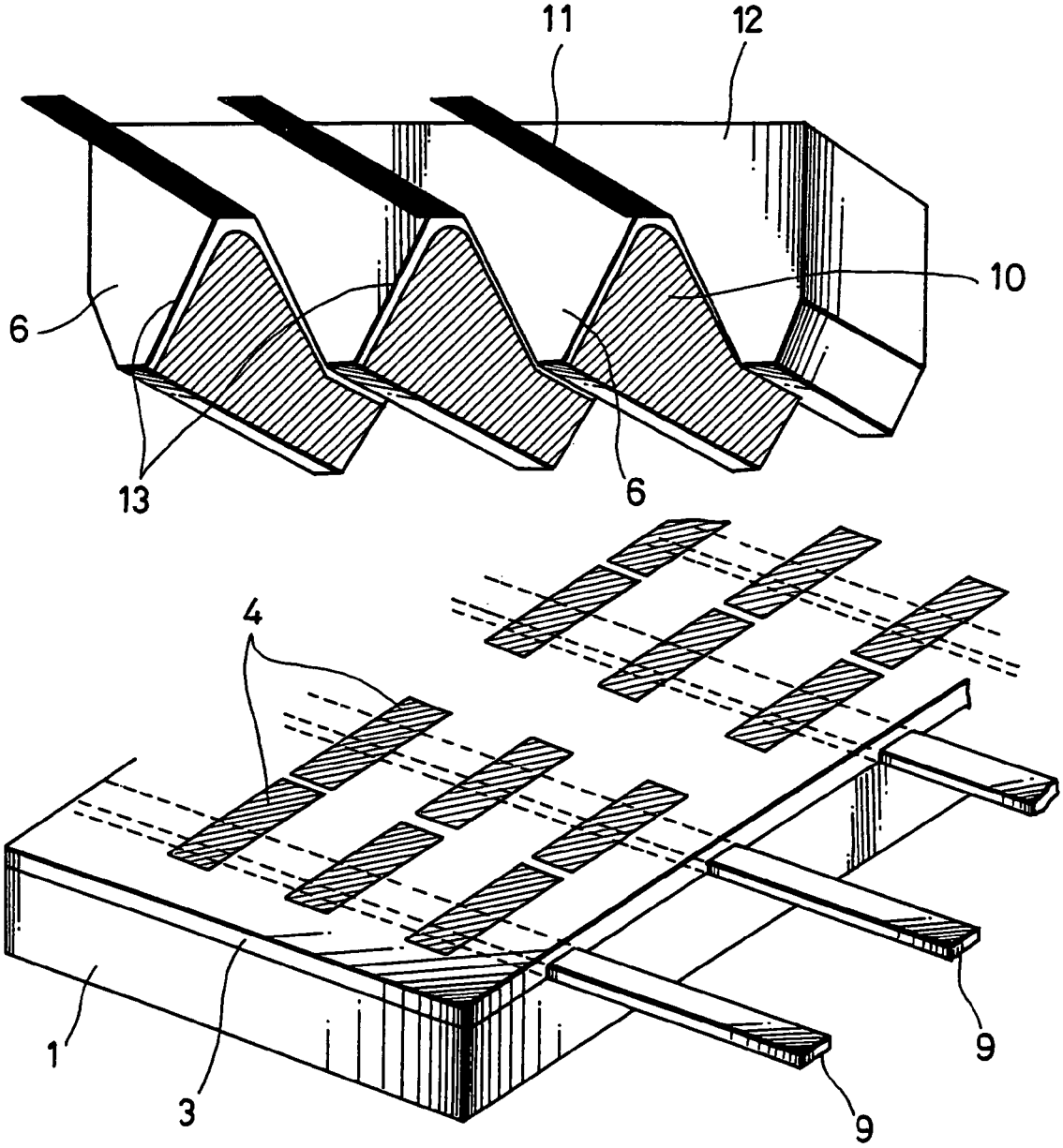
FIG. 4 is a diagram showing a PDP including an electrode structure according to other embodiment of the present invention.

Next, FIG. 4 shows an electrode structure of a PDP according to other embodiment of the present invention.

In the electrode structure of the present invention, the necessary conditions of the island electrode 4 are that it should be the conductive electrode and the conductive electrode has generally an opaque metal surface. Thus, when this electrode structure is applied to the actual PDP, a so-called transmission structure is the most suitable electrode structure in which the island electrode 4 is provided on the rear surface side, the fluorescent screen being provided on the front surface side.

Of course, so long as each electrode is either a transparent electrode or an electrode with a narrow width that may not disturb a visibility, the electrode structure may be a so-called reflection type structure in which upper and lower electrodes are inverted.

The structure of FIG. 4 will be described. This sheet of drawing shows an example of the electrode structure of the present invention that has already been described and in which the island electrode 4 with the pattern shown in FIG. 2C is used on the rear surface side.

The bus electrode 9 is the same as that of the ordinary so-called three-electrode PDP structure in which a plurality of pairs of bus electrodes are extended in the lateral direction as a pair of stripe-shaped electrodes.

The island electrodes 4 are opposed to each other in such a manner that they may cross the above-described bus electrodes 9 as pair of electrodes at every pixel.

A sustain pulse is applied to the pair of bus electrodes 9 and a voltage is applied to the island electrodes 4 which are bonded by the electrostatic capacitance generated by the dielectric layer in an electrostatic capacitance fashion.

In the pattern of the island electrode 4 which is employed as the example shown in FIG. 4, although part of the dielectric layer 3 on the bus electrode 9 is exposed in the discharge space, the secondary electron radiation rate of the dielectric layer 3 is lower than that of the island electrode 4 so that this exposed portion may never discharge. Hence, the bus electrode 9 can be prevented from being operated as the discharge electrode of the ordinary AC type PDP.

On the other hand, a glass substrate 12 in which a groove 13 is formed by treating a plate glass according to the direct sand-blasting or chemical etching is disposed on the front surface side.

A stripe-like address electrode is disposed on the top portion of the groove within the groove 13 of the glass substrate 12. The groove 13 of the front surface side glass substrate 12 is formed in the direction perpendicular to the direction of the bus electrode 9 of the rear surface glass substrate 1. Also, although the remaining portion of the glass substrate 12 is formed as a protruded portion after the groove 13 was formed, this protruded portion becomes the partition 6 shown in FIG. 2. That is, while the partition 6 is formed on the rear surface glass substrate 1 shown in FIG. 1, the partition 6 is formed on the front surface side glass substrate 12 shown in FIG. 4.

A fluorescent substance 10 is coated on the inner wall surface of the groove 13 and the fluorescent substance 10 is exited to emit light by ultraviolet rays generated from discharge produced by the sustain voltage applied to the island electrode 4.

Other arrangement of the electrode structure is also possible, in which the address electrodes 11 are laminated on the rear surface side.

Next, a PDP electrode structure according to a further embodiment of the present invention will be described.

Figure 5A:
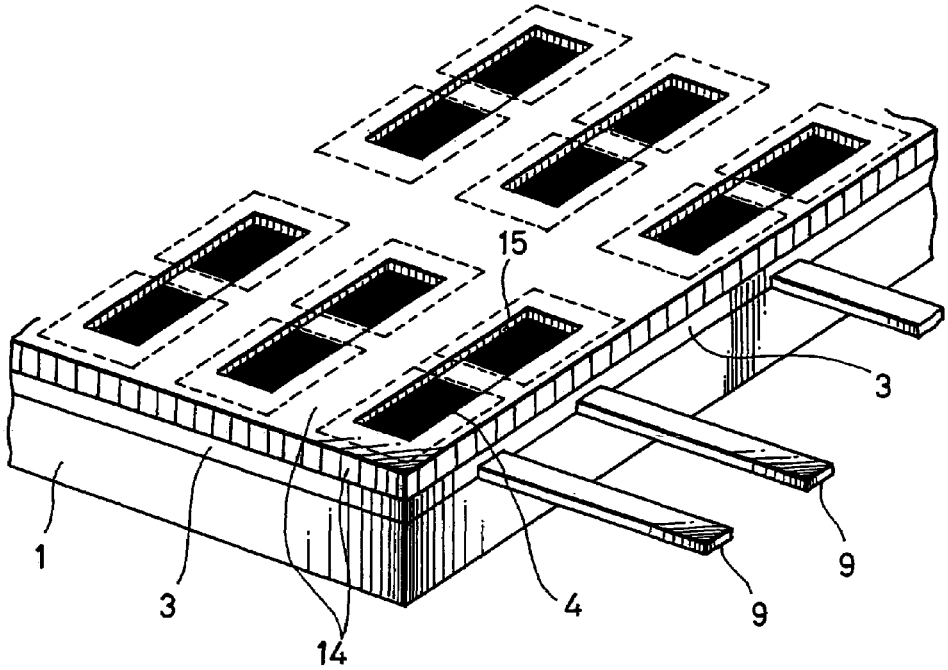
FIG. 5A is a perspective view showing a PDP including an electrode structure according to a further embodiment of the present invention.
Figure 5B:
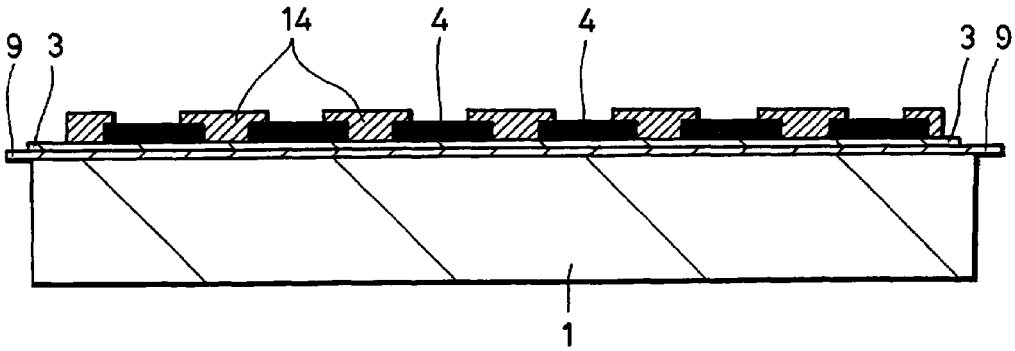
FIG. 5B is a cross-sectional view of the PDP shown in FIG. 5A.

As FIG. 5A shows a perspective view and FIG. 5B shows a cross-sectional view, according to this embodiment, the island electrode 4 is formed wider than that of FIG. 4 and it is shaped like substantially a square electrode. A cover glass 14 having an opening 15 is formed on the central portion of the island electrode 4 while covering the outside portion of the island electrode 4.

Figure 6:
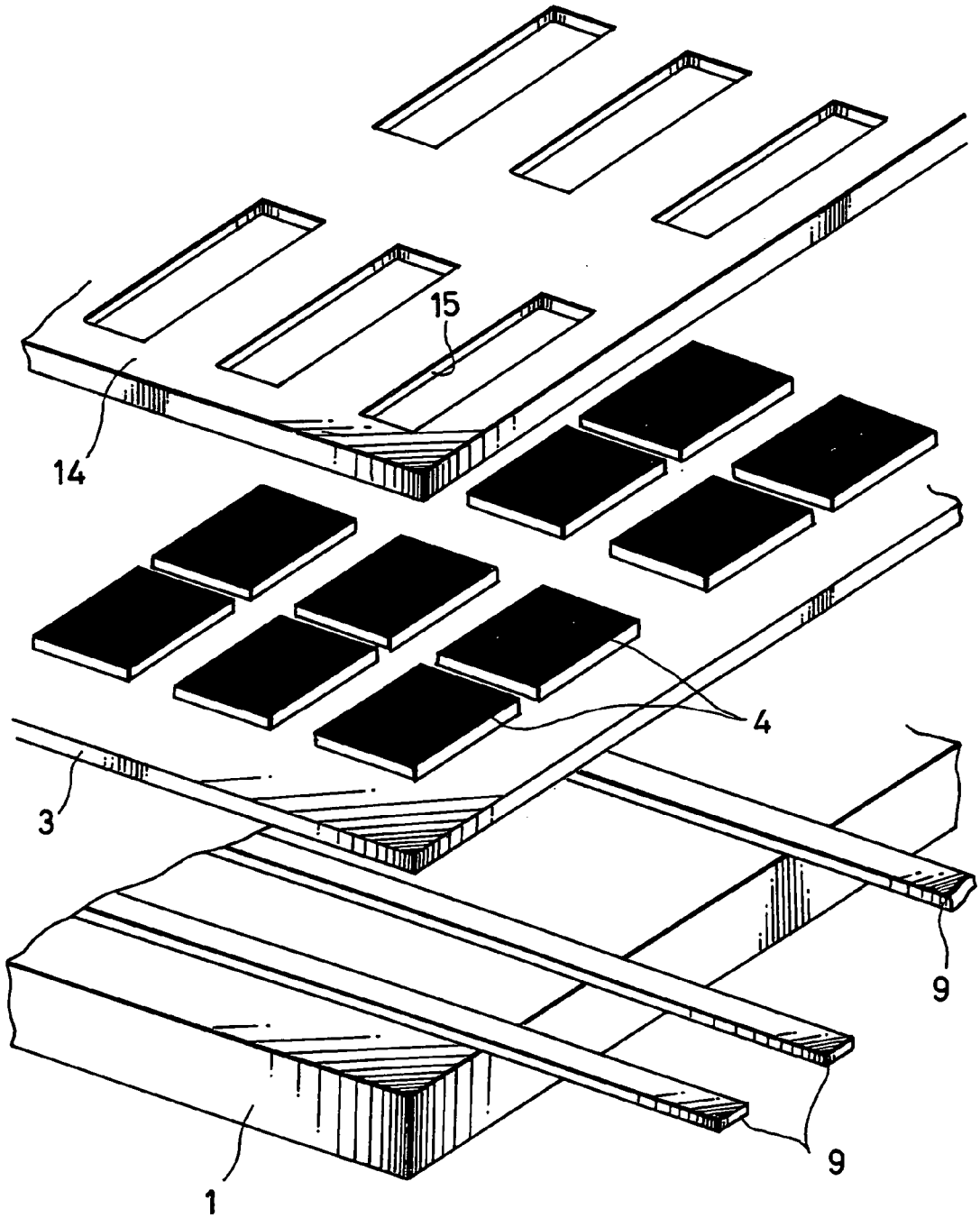
FIG. 6 is an exploded perspective view of the PDP shown in FIG. 5A.

As FIG. 6 shows an exploded perspective view, this structure is constructed in such a manner that the rear surface glass substrate 1 with the bus electrode 9 formed thereon, the dielectric layer 3, the island electrode 4 and the cover glass 14 with the opening 15 formed thereon are laminated with each other. The opening 15 on the cover glass 14 has a length corresponding to the two island electrodes 4 and its width is smaller than that of the island electrode 4. The island electrode 4 is directly exposed within the discharge space at its portion under the opening 15.

According to this embodiment, the area of the island electrode 4 at its portion which contributes to discharge can be stipulated by the opening 15 of the cover glass 14.

Also, according to this embodiment, both of the arrangement in which the partition 6 is provided on the rear surface side as shown in FIG. 1 and the arrangement in which the partition 6 is formed on the front surface side glass substrate 12 as shown in FIG. 4 are possible. Of these arrangements, the arrangement in which the partition 6 is provided on the rear surface side is shown in FIG. 7A (perspective view) and FIG. 7B (cross-sectional view).

Figure 7A:
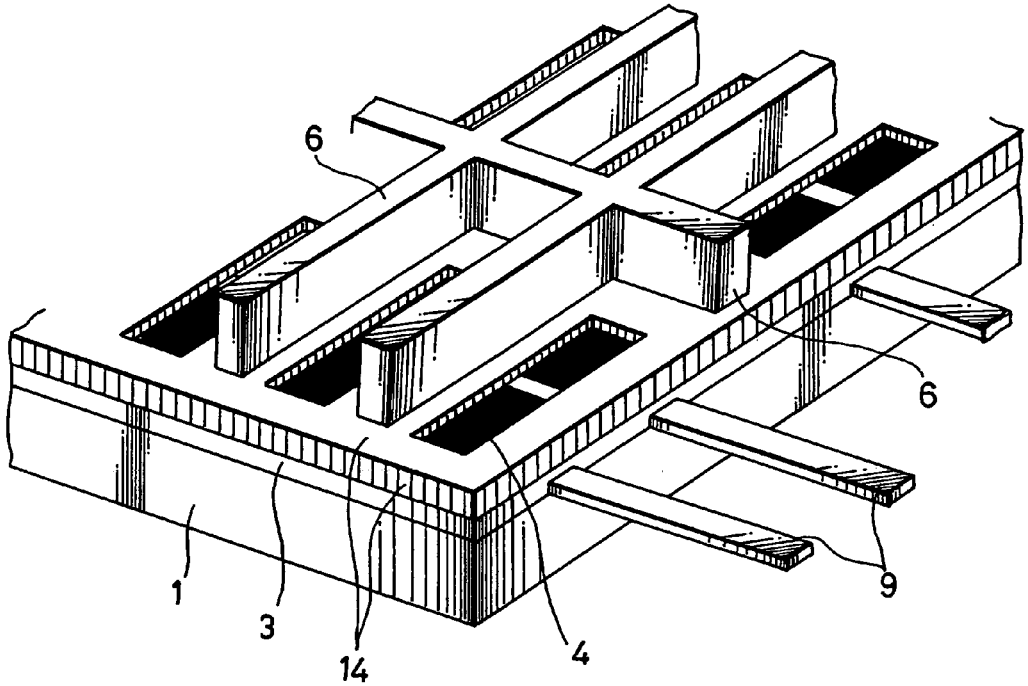
FIG. 7A is a perspective view showing an arrangement in which the PDP shown in FIG. 5A has partitions provided on its rear surface side.
Figure 7B:
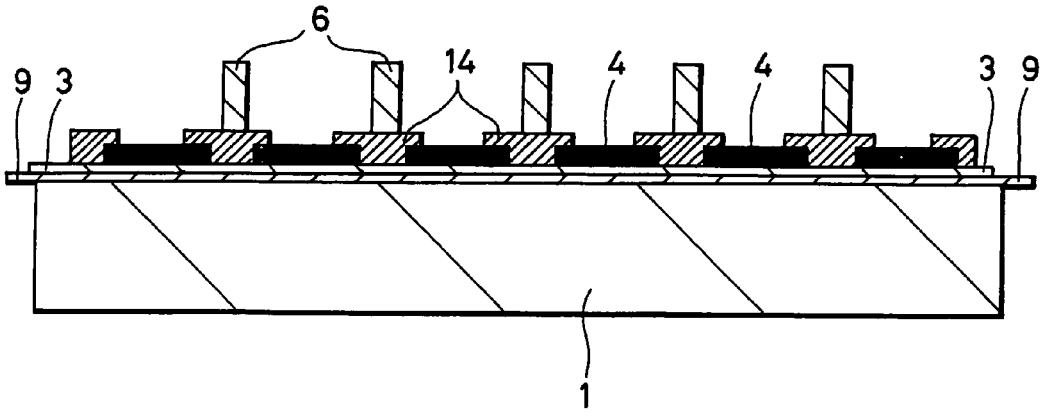
FIG. 7B is a cross-sectional view of the PDP shown in FIG. 7A.

As shown in FIGS. 7A and 7B, the partition 6 is provided in such a manner that it is superposed upon the opening portion 15 of the cover glass 14. While the partition 6 is formed in only the direction perpendicular to the bus electrode 9 as shown in FIG. 1, the partitions 6 are formed in the directions parallel to and perpendicular to the bus electrode 9 so that each opening portion 15 may be divided by the partitions 6.

In addition to the arrangement shown in FIGS. 7A and 7B, although not shown, it is further possible to form a so-called reflection type fluorescent screen by coating the fluorescent substance on other portions than the inner wall of the partition 6 and the opening portion 15 of the cover glass 14.

Figure 8:
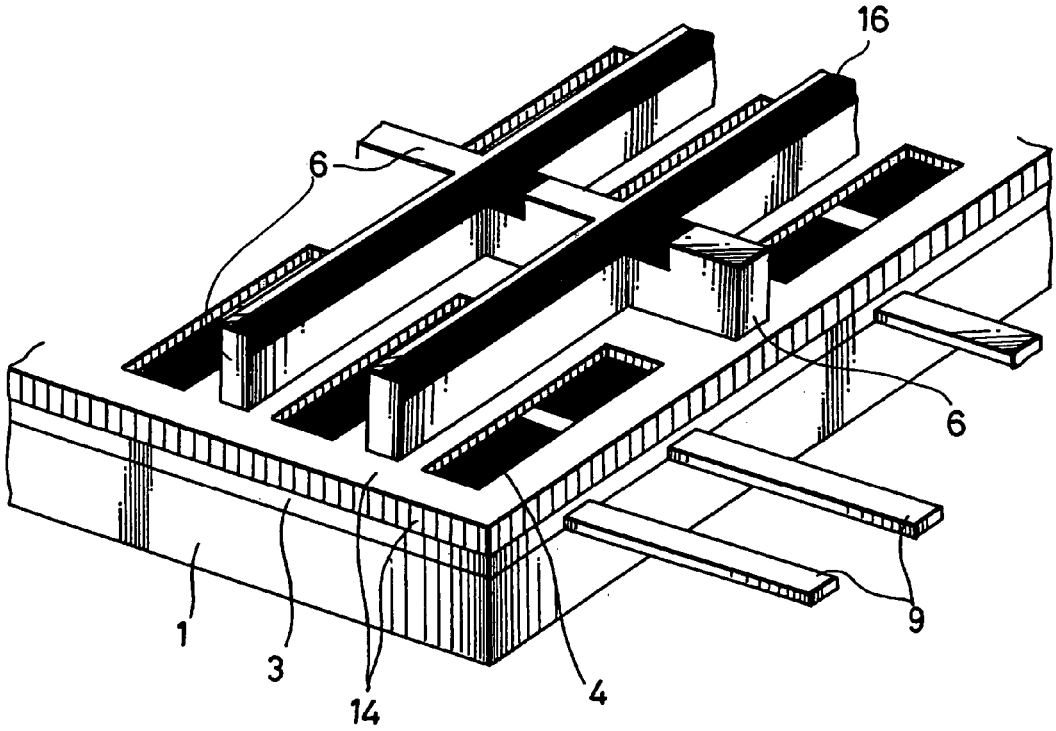
FIG. 8 is a perspective view showing the rear surface side of a PDP according to yet a further embodiment of the present invention.
Figure 9:
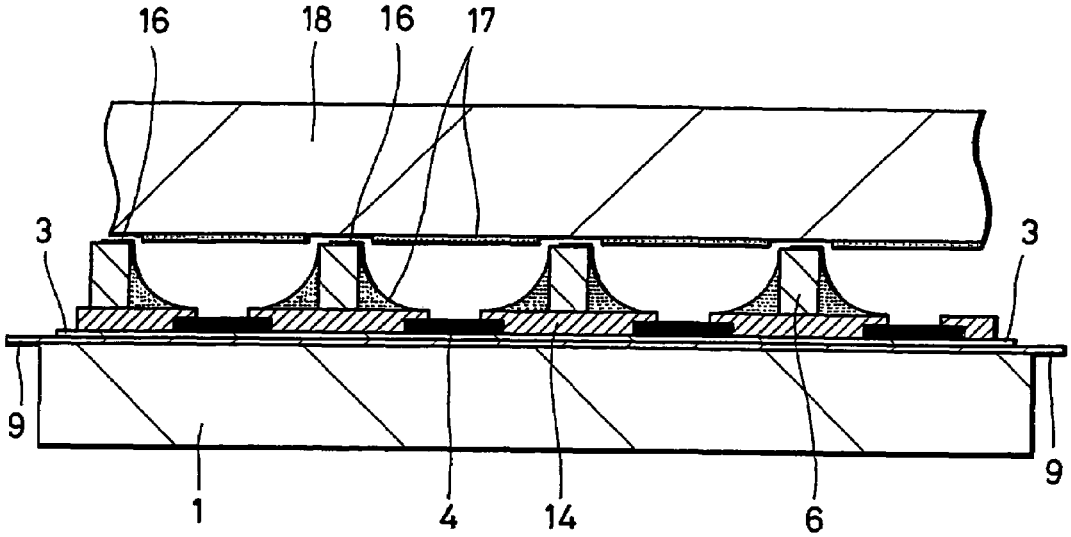
FIG. 9 is a cross-sectional view of a PDP according to still a further embodiment of the present invention.

Next, a PDP electrode structure according to yet a further embodiment of the present invention will be described with reference to FIGS. 8 and 9. FIG. 8 is a perspective view of the rear surface side of the PDP, and FIG. 9 is a cross-sectional view of the PDP.

According to this embodiment, in particular, an address electrode 16 is formed on the partition 6 formed on the rear surface side by coating conductive films on a part of the upper surface of the partition and a part of the inner wall of the partition. The address electrode 16 is formed on the right-hand side of the upper surface of the partition 6 and the upper portion of the right inner wall of the partition 6 in such a manner that it may be extended in the direction perpendicular to the direction of the bus electrode 9 in FIGS. 8 and 9. The address electrode 16 is provided on the partition 6 on the rear surface side and hence the address electrode need not be provided on the front surface side.

Further, a fluorescent substance 17 is coated on other portions than the inner wall of the partition 6 and the opening portion 15 of the cover glass 14. Then, the fluorescent substance 17 is also coated on the surface of the rear surface side (discharge space side) of the front surface side glass substrate 18 in an opposing fashion to the discharge space produced between the partitions 6. Consequently, since the fluorescent substance 17 is widely formed from the side wall to a part of the lower surface and the upper surface in the discharge spaces divided into respective pixels by the partitions 6 and the amount of the fluorescent substance 17 can be increased, an amount of light emitted based on the discharge can be increased to provide brighter display.

Then, since the island electrode 4 is formed by the conductive material with application of the arrangement of the present invention, the electrostatic capacitances can be concentrated by the island electrodes 4 and hence it becomes possible to separate each pixel by forming the partition 6 on the rear surface side as described above. Then, since the address electrode 16 is constructed by forming the conductive film on a part of this partition 6, the bus electrode 9, the island electrode 4 and the address electrode 16 are all formed on the rear surface side, whereby the arrangement of the front surface side such as the front surface side glass substrate 18 can be simplified.

Figure 10:
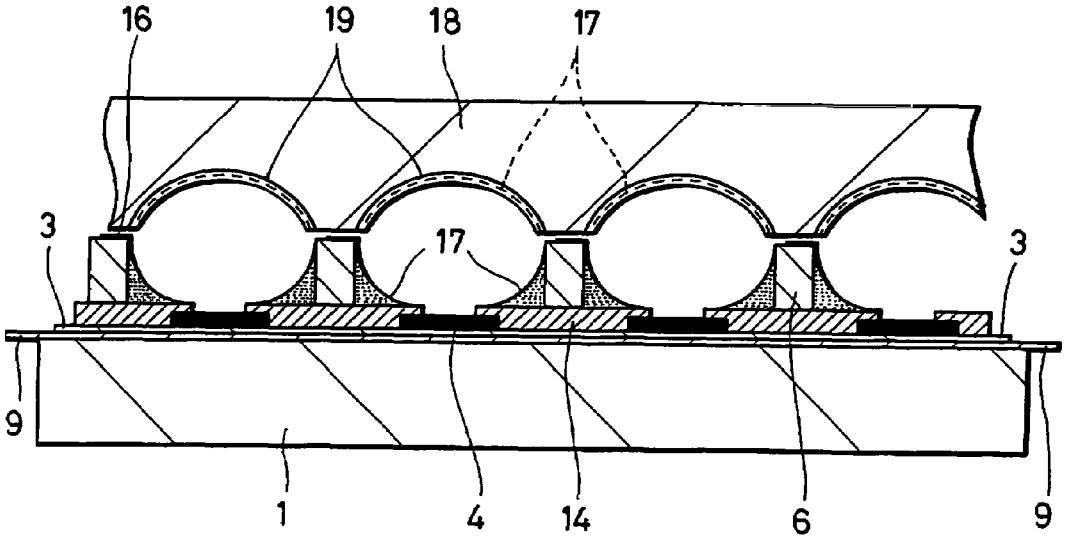
FIG. 10 is a cross-sectional view of a PDP in which the arrangements of FIGS. 8 and 9 are modified.

Also, the cross-sectional view of the embodiment in which the embodiment of FIG. 9 is modified is shown in FIG. 10. In the embodiment shown in FIG. 10, a recess portion 19 of which cross-section is concaved is formed on the front surface side glass substrate 18 and the fluorescent substance 17 is formed on the inner surface of this recess portion 19. As a consequence, an area (volume) of the fluorescent substance 17 on the upper surface can be increased as compared with the arrangement of FIG. 9 by the recess portion 19 of the front surface side glass substrate 18, and hence an amount of light emitted based on the discharge can be increased more.

When the address electrode 16 formed on the lattice-like partition 6 shown in FIG. 8 and the recess portion 19 provided on the front surface side glass substrate 18 shown in FIG. 10 are combined together, the address electrode 16 is brought in contact with the front surface side glass substrate 18 at its portion perpendicular to the bus electrode 9 and its portion exposed to the space is small so that it does not operate as the address electrode. Hence, the address electrode 16 is operated as the address electrode at its protruded portion extending in the direction parallel to the bus electrode 9. That is, although there is a risk that malfunctioning occurs between the address electrode and the adjacent pixel if the address electrode 16 is formed on the partition 6, malfunctioning between the address electrode and the adjacent pixel can be prevented from occurring by the combination of the protruded portion of this address electrode and the recess portion 19 of the front surface side glass substrate 18.

The present invention is not limited to the above-mentioned respective embodiments and can take various arrangements without departing from the gist of the present invention.

The invention claimed is:

1. An AC type PCP structure which comprises a discharge display device having a screen and having a structure in which a bus electrode is covered with a dielectric layer, characterized in that said dielectric layer covering said bus electrode has conductive cathode materials distributed on its surface at every pixel and is not further covered by a secondary electron radiation layer, said bus electrode being a non-discharge electrode and said cathode materials and said bus electrode being coupled through an electrostatic capacitance.

2. The AC type PDP structure according to claim 1 characterized in that a pair of said cathode materials are provided such that tip ends of the cathode materials are closer to each other than to the tip ends of a pair of bus electrodes.

3. The AC type PDP structure according to claim 2, characterized in that said cathode materials form an island electrode.

4. The AC type PDP structure according to claim 2, characterized in that said cathode materials are distributed on the screen at an area smaller than each pixel.

5. The AC type PDP structure according to claim 4, characterized in that said cathode materials form an island electrode.

6. The AC type PDP structure according to claim 1, characterized in that said cathode materials are distributed on the screen at an area smaller than each pixel.

7. The AC type PDP structure according to claim 1, characterized in that said cathode material is lanthanum hexaboride.

8. The AC type PDP structure according to claim 1, characterized in that a substrate including said electrode as a sustain electrode is provided as a rear surface side substrate, a groove is formed on a front surface side substrate to form a discharge space and said groove has an address electrode formed in the direction perpendicular to said electrode formed on said rear surface side substrate and a fluorescent screen formed on the wall surface of said groove.

9. The AC type PDP structure according to claim 1, characterized in that said cathode material is partly covered with a cover glass having an opening, said cathode material being exposed to a discharge space through said opening.

10. The AC type PDP structure according to claim 9, characterized in that said cover glass has a partition superposed thereon so as to surround said opening, a fluorescent substance being formed on said cover glass except the inner wall surface of said partition and said opening.

11. The AC type PDP structure according to claim 10, characterized in that said partition has a conductive material formed on a part thereof to construct an address electrode extending in the direction crossing the direction of said electrode, said fluorescent substance being formed on said front surface side substance at its discharge space side.

12. The AC type PDP structure according to claim 10, characterized in that said partition has a conductive material formed on a part thereof to construct an address electrode extending in the direction crossing the direction of said electrode, said front surface side substrate having a recess portion and said fluorescent substance being formed within said recess portion.

13. The AC type PDP structure according to claim 1, characterized in that said cathode materials is an island electrode.

* * * * *